US010899533B2

(12) United States Patent
Lazaro Ferre

(10) Patent No.: US 10,899,533 B2
(45) Date of Patent: Jan. 26, 2021

(54) REFILLABLE AND FREEZABLE ISOTHERMAL BAG AND METHOD FOR OBTAINING THE SAME

(71) Applicants: Francisco Javier Lazaro Ferre, Barcelona (ES); Catherine Bertin, Barcelona (ES); Victor Lazaro Bertin, Barcelona (ES); Oscar Lazaro Bertin, Barcelona (ES)

(72) Inventor: Francisco Javier Lazaro Ferre, Barcelona (ES)

(73) Assignees: Francisco Javier Lazaro Bertin, Barcelona (ES); Catherine Bertin, Barcelona (ES); Victor Lazaro Bertin, Barcelona (ES); Oscar Lazaro Bertin, Barcelona (ES)

( * ) Notice: Subject to any disclaimer, the term of this patent is extended or adjusted under 35 U.S.C. 154(b) by 0 days.

(21) Appl. No.: 16/500,814

(22) PCT Filed: Apr. 4, 2018

(86) PCT No.: PCT/ES2018/070294
§ 371 (c)(1),
(2) Date: Oct. 3, 2019

(87) PCT Pub. No.: WO2018/185356
PCT Pub. Date: Oct. 11, 2018

(65) Prior Publication Data

US 2020/0108998 A1 Apr. 9, 2020

(30) Foreign Application Priority Data

Apr. 6, 2017 (ES) ..... 201730611

(51) Int. Cl.
*B65D 81/38* (2006.01)
*B65D 33/10* (2006.01)
*B65D 33/25* (2006.01)

(52) U.S. Cl.
CPC ..... *B65D 81/3895* (2013.01); *B65D 33/105* (2013.01); *B65D 33/25* (2013.01)

(58) Field of Classification Search
CPC ..... B65D 81/3895; B65D 81/3897; B65D 81/3855; B65D 81/3872; B65D 81/3883;
(Continued)

(56) References Cited

U.S. PATENT DOCUMENTS 4,889,302 A * 12/1989 Tucker ..... A47G 23/0216 248/146
6,139,188 A 10/2000 Marzano
(Continued)

FOREIGN PATENT DOCUMENTS

WO WO 2006/018456 2/2006
WO WO 2018/185356 10/2018

OTHER PUBLICATIONS

International Search Report and the Written Opinion Dated Aug. 8, 2018 From the International Searching Authority Re. Application No. PCT/ES2018/070294. (12 Pages).

*Primary Examiner* — Jes F Pascua
*Assistant Examiner* — Nina K Attel

(57) ABSTRACT

The invention relates to a refillable and freezable isothermal bag which comprises two plastic bags (6) and (7) and thermal insulation (8) made of polyethylene foam introduced between two bags (6) and (7), including plastic handles (9) joined by heat sealing, the two bags (6) and (7) being joined to each other along a heat sealing line (12), wherein an opening is provided that is envisaged for the introduction of a mixture of water and alcohol, the opening having a composite plastic sheet (1) that has a polyethylene
(Continued)

face and a polyester face, the polyester face having a closing means that are water-resistant and tamper-proof provided to close the opening.

5 Claims, 2 Drawing Sheets

(58) Field of Classification Search
CPC ..... F25D 2303/0831; F25D 2303/0832; F25D 2331/801
USPC ..... 62/451, 457.1, 457.2, 457.7, 457.8, 530; 383/3, 110
See application file for complete search history.

(56) References Cited

U.S. PATENT DOCUMENTS

| | | | |
|---|---|---|---|
| 2008/0298724 | A1 | 12/2008 | Liao et al. |
| 2016/0341464 | A1 | 11/2016 | Bagwell, Sr. |

* cited by examiner

REFILLABLE AND FREEZABLE ISOTHERMAL BAG AND METHOD FOR OBTAINING THE SAME

RELATED APPLICATIONS

This application is a National Phase of PCT Patent Application No. PCT/ES2018/070294 having International filing date of Apr. 4, 2018, which claims the benefit of priority of Spanish Patent Application No. P201730611 filed on Apr. 6, 2017. The contents of the above applications are all incorporated by reference as if fully set forth herein in their entirety.

FIELD AND BACKGROUND OF THE INVENTION

The present invention falls within the sector of manufacturing isothermal plastic bags, with the aim of keeping the temperature of food products purchased at the supermarket cool and frozen until arriving to the user's home.

Mr. Jaime Aguade Silvera invented the cooler bag, utility model 1018834, and an improved cooler bag, utility model 1022681.

Mr. José Luís Falaguera García invented the coolable thermal bag, utility model 1034390.

These two inventions have a drawback in the manufacturing thereof, in that the product they mention consists of a gel or liquid to be cooled, is not defined, and is problem for use, since it can leak if there are leaks or ruptures in the bag, and contaminate the food products. If the liquid is made up of only water it cannot reach freezing temperature below −0° C., moreover, it has a further problem due the fact that ice blocks will form, with edges that can rip the bag and give the bag a poor aesthetic.

As is well known, regulations for keeping frozen products requires a minimum temperature of −18° C., and thus said bags are obsolete for said function.

Mr. Francisco Jávier Lázaro Ferré, applicant and inventor of the present invention, is the author of the invention PCT/ES2005/000375, WO2006/018456 A1, isothermal bags freezable between −0° C. and −80° C. The problem is that said bags weigh more than one kilogram and their weight increases the costs of transportation and the logistics of the deliveries to the commercial outlets and, furthermore, they are not refillable.

However, experience has shown that it is possible to improve the characteristics of bags of isothermal purchases.

SUMMARY OF THE INVENTION

The present invention has been developed with the aim of providing a bag and a manufacturing method that constitutes a novelty within the field of application and solves the disadvantages mentioned above while also providing other additional advantages, which will become evident from the description provided below.

The present invention consists of a refillable and freezable isothermal bag for maintaining a temperature for keeping food products cool and frozen during the transportation of thereof from the supermarket or similar to the user's home. It can also be used on long trips, to go to the beach, to the country or while camping.

As is well known, isothermal bags are made up of two plastic bags and thermal insulation, made of polyethylene foam, which is introduced between both bags. The bags are closed means of heat sealing and rigid plastic handles are heat sealed to the same, which allow them to be carried for the transportation thereof.

The present invention is characterized in that the isothermal bag can be refilled and frozen at user's homes, thanks to the fact that during the manufacturing thereof an opening and a closure is provided, through which users in their homes can put a mixture of water and 96% alcohol, purchased from a pharmacy, (as a non-limiting example, one liter of water and 250 ml of 96% alcohol from a pharmacy) allowing low temperatures to be reached. By adding alcohol, a melting point lower than −18° C. can be reached (depending on the water/alcohol proportion), thereby allowing a proper preservation of the products without the formation of blocks of ice or edges.

This increases the preservation of the frozen products for up to 3 hours, which must be maintained at −18° C., for products that must be kept cool for more than 8 hours, which must be kept between 2° C. and 8° C.

Since crosslinked sodium polyacrylate, in bulk, is very similar in color and texture to sugar or salt, to prevent it from leaking to the outside, and to prevent and the consumption thereof by users, it is characterized in that a dose of 15 or 20 grams of crosslinked sodium polyacrylate is packaged in a little bag manufactured with polyvinyl alcohol (or cellulose paper) for the purpose of that upon contact with liquids it dissolves.

The bag of the invention is characterized by a composite plastic sheet with a polyethylene face and another face that is polyester, with a width of approximately 15 centimeters and a length of 20 centimeters. For the purpose of heat sealing, the polyethylene face is sealed to one of the bags and the polyester face is not sealed, thereby achieving an opening, through which users will introduce water and alcohol. On the upper part of the plastic sheet, on the polyester face, a water-resistant, tamper-proof adhesive (similar to the adhesive of envelopes) is added with which users can seal the opening and prevent leaks.

Another object of the invention is to provide a manufacturing method for a refillable and freezable isothermal bag that comprises two plastic bags and thermal isolation of polyethylene foam introduced between the two bags, characterized by the fact that it consists of placing a composite plastic sheet between the two plastic bags to make an opening between the two plastic bags provided for introducing a mixture of water and alcohol, the composite plastic sheet having a polyethylene face and a polyester face, prior to the application of a heat sealing between both plastic bags, the polyethylene face of the composite plastic sheet being sealed to one face of the bag, such that an opening is created between the composite plastic bag and the bag which is further to the inside.

The manufacturing method includes an additional stage of including crosslinked sodium polyacrylate located on the inside of a bag made of a polyvinyl alcohol or cellulose paper.

Other characteristics and advantages of the bag object of the present invention will be evident from the description of a preferred, but not exclusive, embodiment, which is illustrated by way of non-limiting example in the accompanying drawings, wherein:

BRIEF DESCRIPTION OF THE SEVERAL VIEWS OF THE DRAWINGS

For the purpose of helping to make the present specification more readily understandable, it is accompanied by a set of drawings that, schematically and by way of illustration and not limitation, represent practical embodiments of the freezable and refillable isothermal bag.

DESCRIPTION OF SPECIFIC EMBODIMENTS OF THE INVENTION

In view of the aforementioned figures and, in accordance with the numbering adopted, an example of a preferred embodiment of the invention can be observed therein, which comprises the parts and elements indicated and described in detail below.

Figure 1:
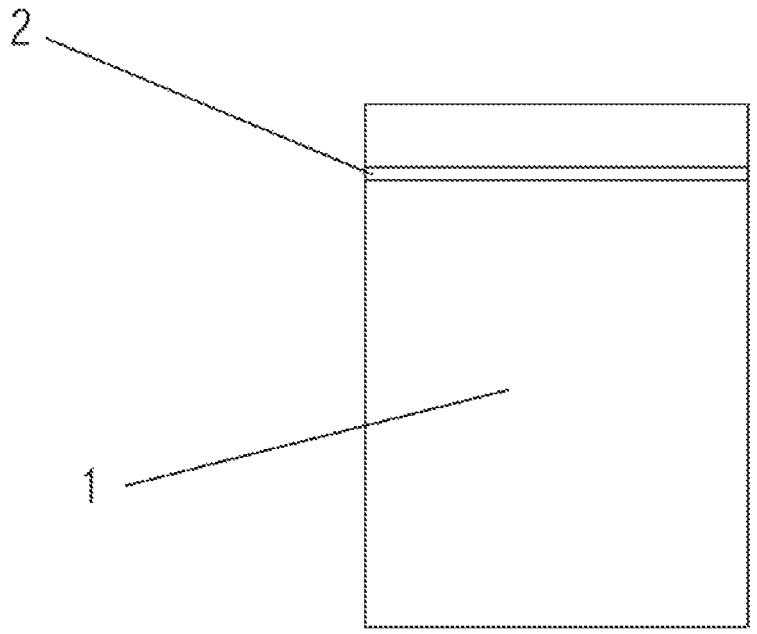
FIG. 1 shows a front elevation view of a composite plastic sheet, approximately 15 centimeters wide and 20 centimeters high, wherein one of the faces thereof is polyethylene and the other face is polyester.
Figure 2:
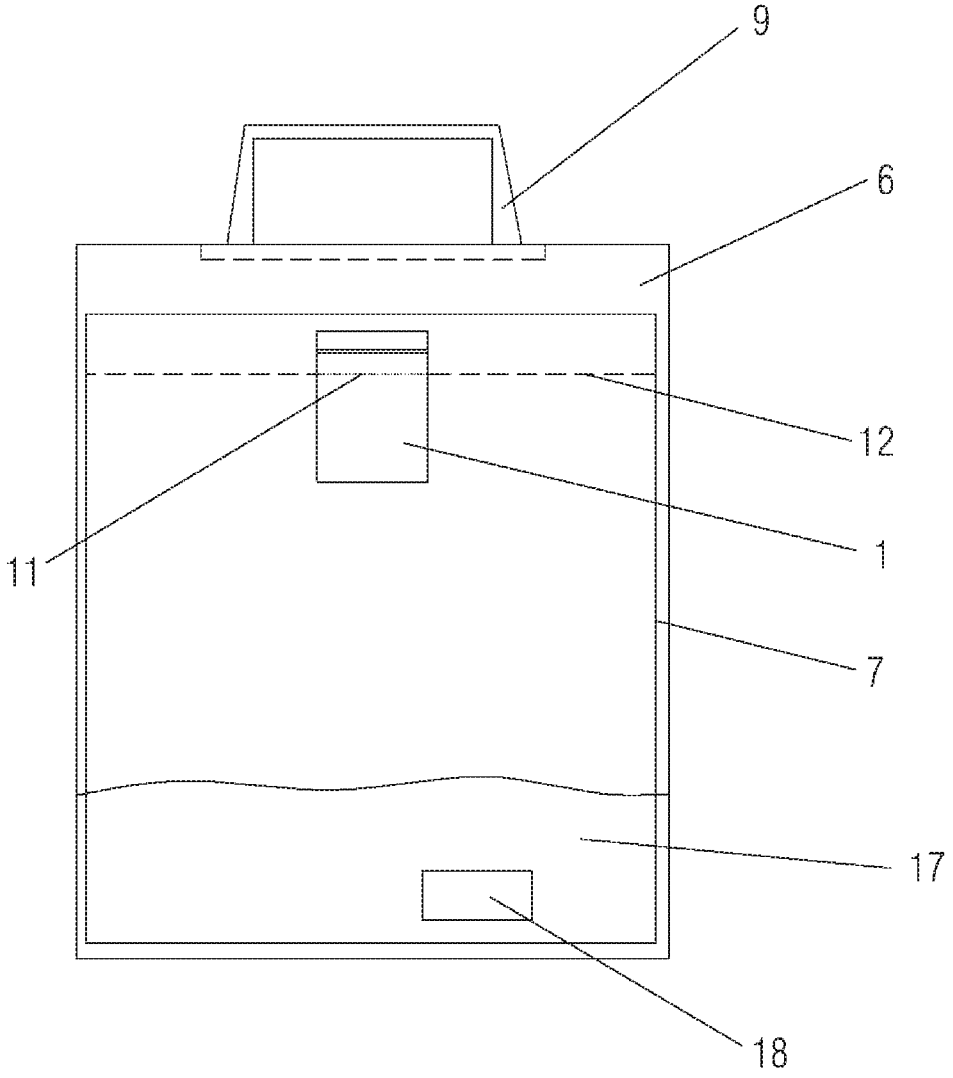
FIG. 2 shows a schematic front view of an embodiment of a refillable and freezable isothermal bag, according to the present invention.

FIG. 2 shows a front view of a refillable and freezable isothermal bag made up of two plastic bags (6) and (7) and thermal insulation (8), made of polyethylene foam, which is introduced between both bags (6) and (7), and by means of heat sealing (9) rigid plastic handles are sealed, which allow the bags to be held for the transportation thereof. The two bags (6) and (7) are connected to each other by a heat sealing line (12) (indicated by a dashed line) which keeps them joined in a non-releasable way.

One embodiment is characterized in that it uses a sheet (1) of composite plastic with one polyethylene face, the other face being polyester, the size being 15 centimeters wide and 20 centimeters long. Added to the polyester face along the width on one of the sides of the upper part is a water-resistant and tamper-proof adhesive (2), for the purpose of sealing by means of heat sealing between both bags, which make up the isothermal bag, the polyethylene face being sealed to the bag (7) and the polyester face not sealed to the bag (6). As is well known, polyester is not sealed to polyethylene, an opening (11) is left open that is approximately 15 centimeters, through which users in their homes can fill up the bag with water and alcohol and then close it thanks to the adhesive that has been added to the polyester face to prevent the liquid (17) from leaking. Since it is a tamper-proof adhesive it cannot be opened.

On one side of the bag (6) pictograms or indications are printed, indicating where the opening is and where the water and alcohol liquid must be introduced, indicating the freezing point, according to the mixture of water and alcohol.

Users in their homes can introduce a mixture of 1 liter of water and 250 milliliters of alcohol 96% from the pharmacy, reaching a melting point of −20° C., allowing the preservation of the frozen products and cool products to be increased. Previously, a liquid superabsorbent is introduced in the inside of the isothermal bag (6) and (7) during the manufacturing thereof, made of crosslinked sodium polyacrylate (17) in order to prevent leakage. To prevent the same from leaking to the outside and the consumption thereof by the users, it is characterized in that a dose of 15 or 20 grams of crosslinked sodium polyacrylate is packaged in a little bag (18) manufactured with polyvinyl alcohol or cellulose so that upon contact with liquids it dissolves.

Since crosslinked sodium polyacrylate, in bulk, is very similar in color and texture to sugar or salt, it is necessary to prevent it from leaking to the outside and the consumption thereof by the users.

What is claimed is:

1. A refillable and freezable isothermal bag which comprises two plastic bags (6) and (7) and thermal insulation (8) made of polyethylene foam introduced between the two bags (6) and (7), including plastic handles (9) joined by heat sealing, the two bags (6) and (7) being joined to each other along a heat sealing line (12), characterized by the fact that an opening is provided that is envisaged for the introduction of a mixture of water and alcohol, the opening having a composite plastic sheet (1) that has a polyethylene face and a polyester face, the polyester face having closing means that are water-resistant and tamper-proof provided to close the opening.

2. The refillable and freezable isothermal bag according to claim 1, characterized by the fact that the closing means comprise a sheet made of adhesive material.

3. The refillable and freezable isothermal bag according to claim 1, characterized by the fact that the closing means comprise a zipper type closure.

4. A manufacturing method for a refillable and freezable isothermal bag that comprises two plastic bags (6) and (7) and thermal insulation (8) of polyethylene foam introduced between the two bags (6) and (7), characterized by the fact that it consists of placing a composite plastic sheet (1) between the two plastic bags (6) and (7) to make an opening between the two plastic bags (6) and (7) provided for introducing a mixture of water and alcohol, the composite plastic sheet (1) having a polyethylene face and a polyester face, prior to the application of a heat sealing between the two plastic bags (6) and (7), the polyethylene face of the composite plastic sheet (1) being sealed to one face of one of the two plastic bags (6), such that the opening (11) is created between the composite plastic sheet (1) and the other one of the two plastic bags (7).

5. The manufacturing method of a refillable and freezable isothermal bag according to claim 4, characterized by the fact that it includes an additional stage of including crosslinked sodium polyacrylate placed inside of a bag made of a polyvinyl alcohol or cellulose paper.

* * * * *